US011801679B2

(12) United States Patent
Ueno

(10) Patent No.: US 11,801,679 B2
(45) Date of Patent: Oct. 31, 2023

(54) IMAGE FORMING APPARATUS

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 13 days.

(21) Appl. No.: 17/703,500

(22) Filed: Mar. 24, 2022

(65) Prior Publication Data

US 2022/0314612 A1 Oct. 6, 2022

(30) Foreign Application Priority Data

Mar. 30, 2021 (JP) ..... 2021-057092

(51) Int. Cl.
*B41J 2/165* (2006.01)

(52) U.S. Cl.
CPC ..... *B41J 2/16505* (2013.01); *B41J 2/16588* (2013.01); *B41J 2/16508* (2013.01); *B41J 2/16535* (2013.01); *B41J 2/16547* (2013.01)

(58) Field of Classification Search
CPC .... B41J 2/165; B41J 2/16588; B41J 2/16508; B41J 2/16535; B41J 2/16547; B41J 2/16505
See application file for complete search history.

(56) References Cited

U.S. PATENT DOCUMENTS 8,708,451 B2 4/2014 Kaisha et al.

FOREIGN PATENT DOCUMENTS

DE 2481589 A1 * 8/2012 ..... B41J 2/165
JP 2013-035174 A 2/2013

* cited by examiner

*Primary Examiner* — Geoffrey S Mruk
(74) *Attorney, Agent, or Firm* — Studebaker & Brackett PC

(57) ABSTRACT

An image forming apparatus includes a recording head, a cap, a tank, a pump, a third communication pipe and a controller. The cap forms a sealed space including an ejection port of the recording head. The tank is connected to the sealed space through a first communication pipe and generates a humidified air. The pump feeds the humidified air to the sealed space through the first communication pipe. The third communication pipe connects the pump and the sealed space. The controller is performable a capping operation to feed the humidified air to the sealed space and a long-period leaving operation to feed the humidifying liquid in the tank to the sealed space through the third communication pipe and to stop a driving of the pump after a predetermined amount of the humidifying liquid is fed in the sealed space.

5 Claims, 5 Drawing Sheets

IMAGE FORMING APPARATUS

INCORPORATION BY REFERENCE

This application is based on and claims the benefit of priority from Japanese patent application No. 2021-057092 filed on Mar. 30, 2021, which is incorporated by reference in its entirety.

BACKGROUND

The present disclosure relates to an inkjet type image forming apparatus provided with a capping unit which protects an ink ejection port of a recording head.

The inkjet type image forming apparatus is provided with a capping unit which prevents drying of an ink ejection port of a nozzle of a recording head. The capping unit includes a cap which comes into tightly contact with the lower surface of the recording head and forms a sealed space including the ink ejection port. When an image forming operation is not performed during normal use, a pump is driven to feed humidified air into the sealed space, and the humidity of the sealed space is maintained at about 80%.

On the other hand, when the humidifying liquid is stored in the sealed space, the evaporation of the moisture advances to the saturated vapor pressure, and the humidity of the sealed space becomes 100%. Then, the ink in the nozzle absorbs the moisture, and the ink ejection performance is deteriorated. When the ejection performance is deteriorated in this way, it is difficult to recover the ejection performance by the ink discharge operation such as flushing, and an operation (purge) for forcibly ejecting the ink from the nozzle is required. Therefore, during normal use, the humidified air is fed into the sealed space to maintain the humidity at about 80%.

However, if the image forming apparatus is not used for a long period of time, the power of the image forming apparatus may be turned off. Then, since the drive of the pump is stopped, the humidified air cannot be fed into the sealed space, and the humidity in the sealed space decreases, and the ink in the nozzle thickens.

Then, when the power source is turned on after a predetermined period of time has elapsed, a forced discharge operation in which after the humidified air is fed to the sealed space, the ink is discharged forcibly from an ink ejection port may be performed for a plurality of times.

However, when the forced discharge operation is performed for a plurality of times, there is a problem that the image forming operation cannot be started quickly because it is required to feed the humidified air to the sealed space when the power is turned on after a predetermined period of time has elapsed. In addition, there is a problem that ink consumption increases with the plurality of forced discharge operations.

SUMMARY

In accordance with an aspect of the present disclosure, an image forming apparatus includes a recording head, a cap, a tank, a pump, a third communication pipe and a controller. The recording head has a lower surface on which an ink ejection port is formed. The cap forms a sealed space including the ejection port. The tank is connected to the sealed space through a first communication pipe and stores a humidifying liquid to generate a humidified air. The pump feeds air into the humidifying liquid in the tank through a second communication pipe and feeds the humidified air to the sealed space through the first communication pipe. The third communication pipe connects the pump and the sealed space. The controller is performable a capping operation to drive the pump in one direction to feed the humidified air to the sealed space and a long-period leaving operation to drive the pump in the other direction to feed the humidifying liquid in the tank to the sealed space through the third communication pipe and to stop a driving of the pump after a predetermined amount of the humidifying liquid is fed in the sealed space.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus according to one embodiment of the present disclosure will be described with reference to the drawings.

Figure 1:
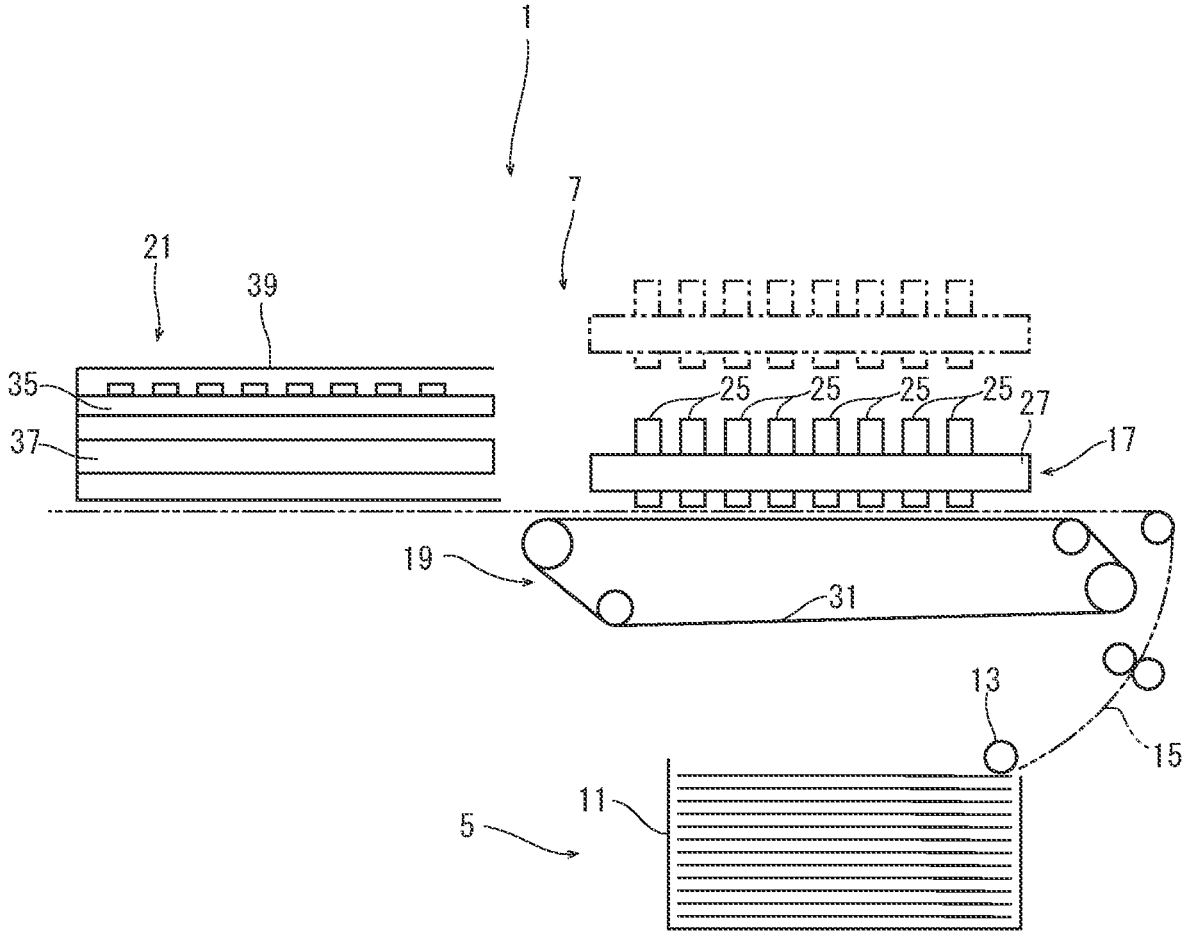
FIG. 1 is a front view schematically showing an inner structure of an image forming apparatus according to one embodiment of the present disclosure.

The image forming apparatus 1 will be described with reference to FIG. 1. FIG. 1 is a front view schematically showing an internal structure of an image forming apparatus 1 (at a time of an image forming operation). Fr, Rr, L, and R marked in each drawing indicate the front, the rear, the left, and the right sides of the image forming apparatus 1, respectively.

The image forming apparatus 1 includes a sheet feeding part 5 and an inkjet type image forming part 7. The sheet feeding part 5 includes a sheet feeding cassette 11 in which a sheet S is stored, and a sheet feeding device 13 which feeds the sheet S from the sheet feeding cassette 11 to a conveyance path 15. The image forming part 7 includes a head unit 17, a conveyance unit 19, and a maintenance unit 21.

Figure 2:
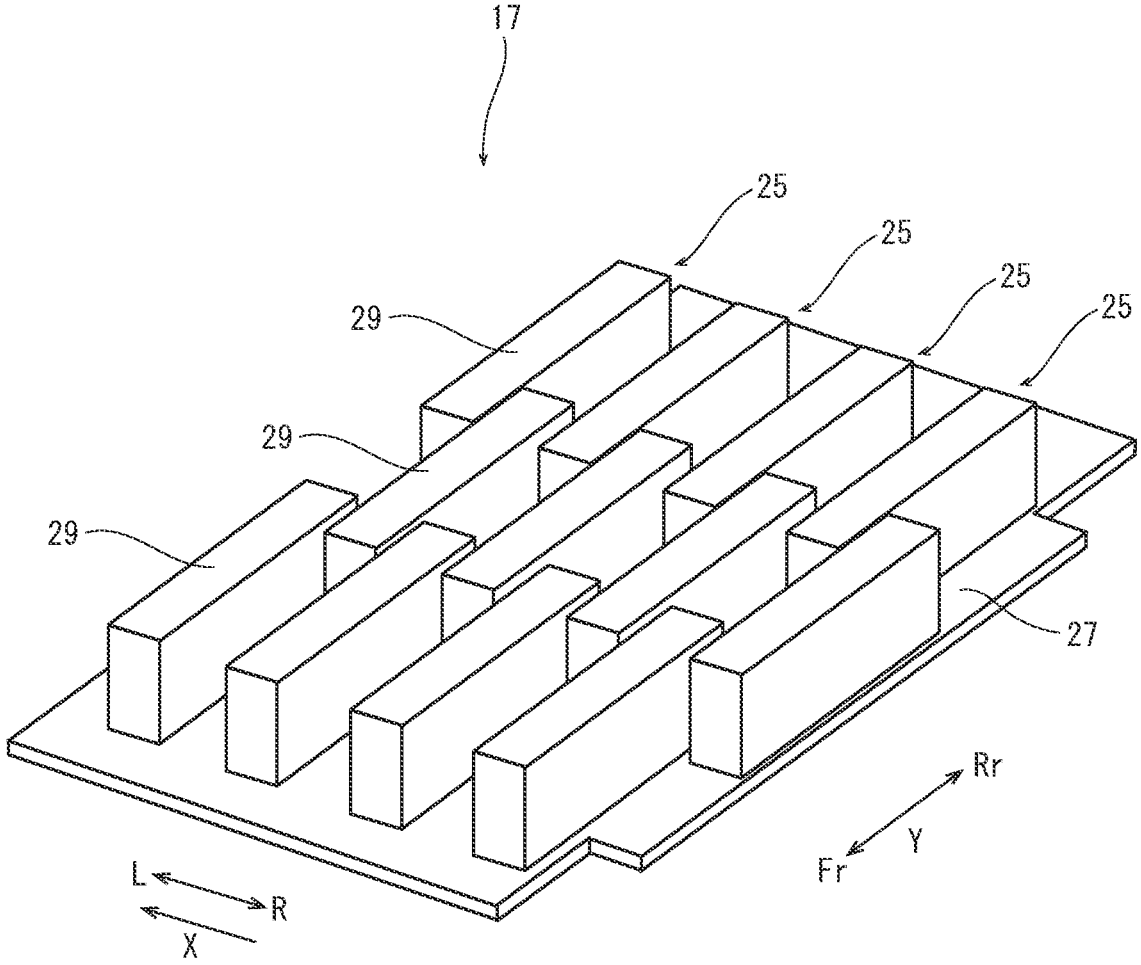
FIG. 2 is a perspective view schematically showing a head unit, in the image forming apparatus according to the embodiment of the present disclosure.

The head unit 17 will be described with reference to FIG. 2. FIG. 2 is a perspective view showing the head unit 17.

The head unit 17 includes four line heads 25 corresponding to inks of four colors (yellow, magenta, cyan, and black) and a base plate 27 on which the four line heads 25 are supported. The four line heads 25 are arranged in parallel along the sheet conveyance direction X (the left-and-right direction) and supported by the base plate 27.

Each line head 25 includes three recording heads 29. Each recording head 29 has a rectangular parallelepiped shape long in the width direction Y (the front-and-rear direction) orthogonal to the conveyance direction X, and is provided with a number of nozzles arranged in the conveyance direction X and the width direction Y. The ejection port of each nozzle is opened to the lower surface of the recording head 29. Each nozzle ejects the ink downward from the ejection port by an ink ejection manner such as a piezo type or a thermal type. An area where the ejection ports are opened to the lower surface of the recording head 29 is defined as a nozzle area.

The head unit 17 is supported so as to be lifted and lowered between a printing position (see the solid line in FIG. 1) and a retreat position above the printing position (see the two-dotted line in FIG. 1).

With reference to FIG. 1 again, the conveyance unit 19 includes a conveyance belt 31 which circulates in the counterclockwise direction of FIG. 1. The conveyance unit 19 is disposed such that the upper traveling surface of the conveyance belt 31 is close to the nozzle areas of the four line heads 25 of the head unit 17 (see the solid line in FIG. 1) lowered to the printing position.

The maintenance unit 21 includes a capping unit 35, a wiping unit 37, and a case 39 in which the capping unit 35 and the wiping unit 37 are housed.

Figure 3:
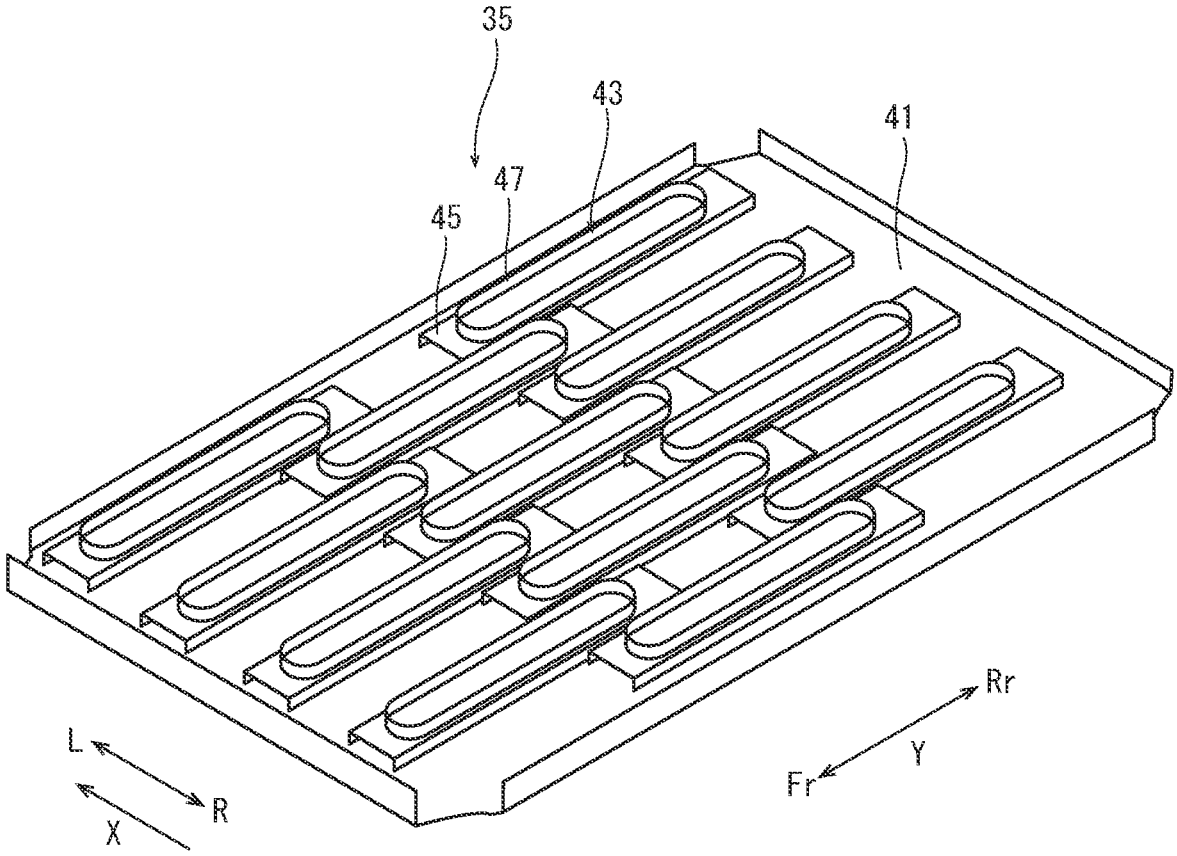
FIG. 3 is a perspective view schematically showing a capping unit, in the image forming apparatus according to the embodiment of the present disclosure.

The capping unit 35 will be described with reference to FIG. 3. FIG. 3 is a perspective view showing the capping unit 35.

The capping unit 35 includes a base plate 41 and caps 43 arranged on the upper surface of the base plate 41 so as to correspond to the recording heads 29 of the head unit 17. Each cap 43 has a bottom wall 45 and an annular circumferential wall 47 stood on the bottom wall 45 and surrounding the circumference of the recording head 29. As shown in FIG. 1, the capping unit 35 is supported in the upper space in the case 39, and is movable between a housing position housed in the case 39 and a capping position moved rightward through the opening of the case 39.

With reference to FIG. 1 again, the wiping unit 37 includes a base plate and wipers arranged on the upper surface of the base plate so as to correspond to the recording heads 29 of the head unit 17. The wiper is supported by the base plate in a movable manner in the longitudinal direction (the width direction Y) of the recording head 29. The wiping unit 37 is housed in the lower space in the case 39, and is movable between a housing position housed in the case 39 and a wiping position moved rightward through the opening of the case 39.

Next, the image forming operation and the maintenance operation will be briefly described. At a time of the image forming operation, the maintenance unit 21 (the capping unit 35 and the wiping unit 37) is moved to the housing position. The head unit 17 is lowered to the printing position. The sheet fed from the sheet feeding cassette 11 by the sheet feeding device 13 is conveyed to the conveyance unit 19 along the conveyance path 15. When the sheet is conveyed below the head unit 17 by the conveyance belt 31 of the conveyance unit 19, the ink is ejected from the nozzles corresponding to the image data to form an image on the sheet. The sheet on which the image is formed is conveyed along the conveyance path 15 and then discharged.

At a time of the capping operation, the head unit 17 is lifted to the retreat position, and after the capping unit 35 is moved to the capping position, the head unit 17 is lowered. Thus, each cap 43 (the circumferential wall 47) comes into tightly contact with the circumference of the nozzle area of the recording head 29 of the head unit 17, and a sealed space including the nozzle area of the recording head 29 is formed between the cap 43 and the base plate 27. At this time, the sealed space is humidified by a humidifying mechanism described later to prevent drying of the ejection port. The humidification mechanism will be described later.

At a time of the wiping operation, the head unit 17 is lifted to the retreat position, and after the wiping unit 37 is moved to the wiping position, the head unit 17 is lowered. Thereafter, each wiper is moved along the nozzle area so that the ink adhering to the ejection ports of the nozzles is wiped off by the wiper.

Figure 4A:
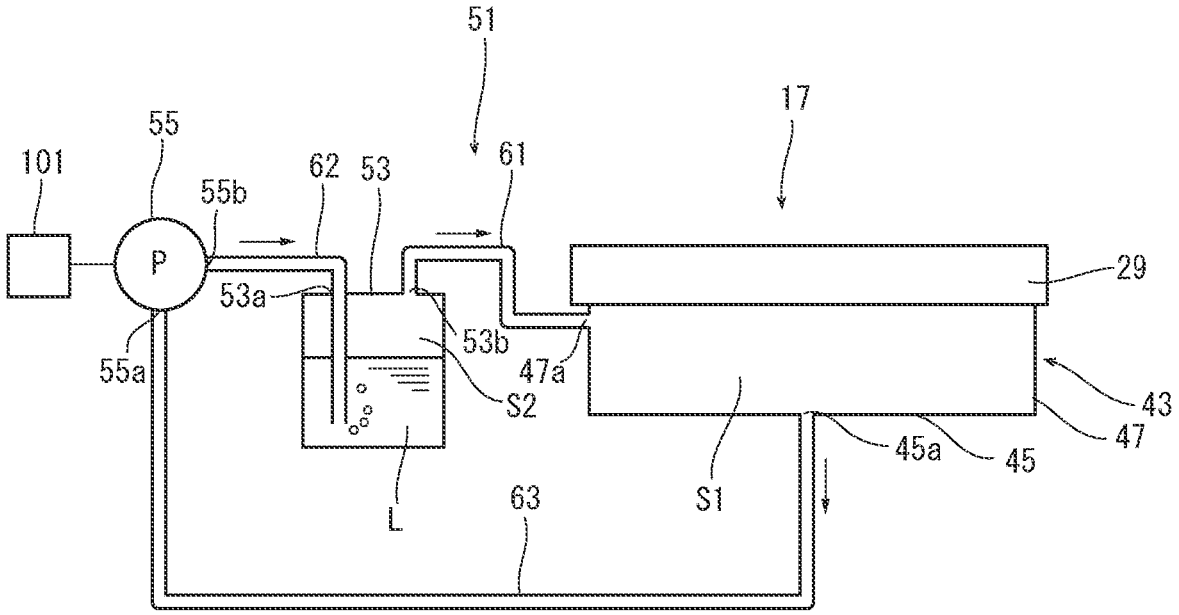
FIG. 4A is a view explaining a humidifying operation at normal use by a humidifying mechanism in the first example, in the image forming apparatus according to the embodiment of the present disclosure.
Figure 4B:
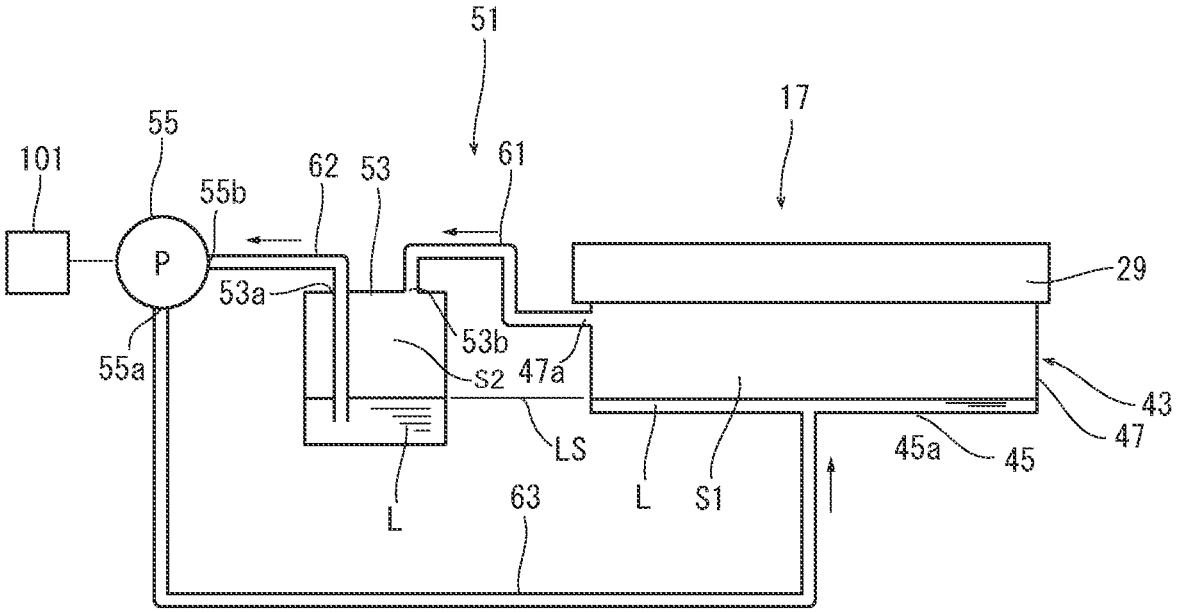
FIG. 4B is a view explaining the humidifying operation at long period non-use by the humidifying mechanism in the first example, in the image forming apparatus according to the embodiment of the present disclosure.

Next, the humidifying mechanism 51 according to the first example of the capping unit 35 will be described with reference to FIG. 4A and FIG. 4B. FIG. 4A and FIG. 4B are views schematically showing the humidifying mechanism 51. The humidifying mechanism 51 includes a tank 53, a pump 55 and a third communication pipe 63. The tank 53 is connected to the sealed space S1 formed between the recording head 29 of the head unit 17 and the cap 43 through a first communication pipe 61. The pump 55 is connected to the tank 53 through a second communication pipe 62. The third communication pipe 63 connects the cap 43 and the pump 55.

As described above, the cap 43 has the bottom wall 45 and the circumferential wall 47 surrounding the nozzle area of the recording head 29. At the time of the capping operation, the sealed space S1 including the nozzle area is formed between the cap 43 and the base plate 27. The circumferential wall 47 has an inflow port 47*a*, and the bottom wall 45 has an outflow port 45*a*.

The tank 53 has a sealed internal space. In the internal space, a humidifying liquid L (for example, an ion exchange water) is stored. As the humidifying liquid L is stored in this way, the humidifying liquid L is evaporated and the internal space S2 above the liquid level of the humidifying liquid L is humidified to the saturated vapor pressure. The tank 53 has an inflow port 53*a* and an outflow port 53*b* which are formed at a portion above the liquid level of the humidifying liquid L (the upper wall, in this example). The outflow port 53*b* of the tank 53 and the inflow port 47*a* of the cap 43 are connected by the first communication pipe 61. Thus, the internal space S2 of the tank 53 is communicated with the sealed space S1 of the cap 43.

The pump 55 is a bi-directional pump having a suction port 55*a* and a discharge port 55*b*. When the pump 55 is driven in one direction, gas or liquid is sucked through the suction port 55*a* and is discharged through the discharge port 55*b*. When the pump 55 is driven in the other direction, gas or liquid is sucked through the discharge port 55*b* and discharged through the suction port 55*a*. The pump 55 can be switched between a normal mode in which the pump is driven in one direction and a reverse rotation mode in which the pump 55 is driven in the other direction. The pump 55 is electrically connected to a controller 101, and is controlled by the controller 101 to be switched to the normal mode or the reverse rotation mode. Alternatively, the pump 55 may be manually switched to the normal mode or the reverse rotation mode.

The discharge port 55*b* of the pump 55 and the inflow port 53*a* of the tank 53 are connected by the second communication pipe 62. The second communication pipe 62 enters the internal space S2 of the tank 53 through the inflow port 53*a*, and the tip opening of the second communication pipe 62 is opened below the liquid level of the humidifying liquid L.

The suction port 55*a* of the pump 55 and the outflow port 45*a* of the bottom wall 45 of the cap 43 are connected by the third communication pipe 63. Thus, the sealed space S1 of the cap 43, the first communication pipe 61, the internal space S2 of the tank 53, the second communication pipe 62, and the third communication pipe 63 form a closed system.

The humidifying operation by the humidifying mechanism 51 according to the first example having the above configuration will be described with reference to FIG. 4A and FIG. 4B. The humidifying mechanism 51 is configured to perform a capping operation and a long-period leaving operation. The capping operation is performed in a case where the power of the image forming apparatus 1 is turned on and the image forming operation is not performed, for example. The long-period leaving operation is performed before the power of the image forming apparatus 1 is turned off in a case where the power of the image forming apparatus 1 is turned off and the image forming apparatus 1 is not used for a predetermined period or longer.

First, the capping operation will be described. In the capping operation, when it is determined that the power of the image forming apparatus 1 is turned on, the controller 101 switches the pump 55 to the normal mode. Thus, the pump 55 is driven in one direction. Then, as shown by the arrow in FIG. 4A, air is sucked from the suction port 55*a* through the third communication pipe 63, and the sucked air is discharged from the discharge port 55*b*. The discharged air is fed into the humidifying liquid L of the tank 53 through the second communication pipe 62, and blown into the internal space S2 through the humidifying liquid L. The blown air is replaced with the humidified air in the internal space S2, and the humidified air is fed into the sealed space S1 through the first communication pipe 61.

In the above manner, a flow passage returning from the pump 55 to the pump 55 through the second communication pipe 62, the internal space S2 of the tank 53, the first communication pipe 61, the sealed space S1 of the cap 43, and the third communication pipe 63 (see the arrow in FIG. 4A) is formed. While the pump 55 is driven, the humidified air in the internal space S2 of the tank 53 is continuously fed into the sealed space S1 through the first communication pipe 61, and then the sealed space S1 is humidified. For example, the humidity of the sealed space S1 is maintained at about 80%.

Next, the long-period leaving operation will be described. In the long-period leaving operation, before the power of the image forming apparatus 1 is turned off, the controller 101 switches the pump 55 to the reverse rotation mode. Thus, the pump 55 is driven in the other direction for a predetermined time. Then, as shown by an arrow in FIG. 4B, a flow passage retuning from the pump 55 to the pump 55 through the third communication pipe 63, the sealed space S1 of the cap 43, the first communication pipe 61, the internal space S2 of the tank 53, and the second communication pipe 62 is formed. Then, the humidifying liquid L in the tank 53 is taken into the pump 55 through the second communication pipe 62 from the discharge port 55*b*, fed into the third communication pipe 63 from the suction port 55*a*, and then fed to the sealed space S1 from the outflow port 45*a* of the bottom wall 45 of the cap 43.

When the humidifying liquid L is fed to the sealed space S1 until the liquid level LS of the humidifying liquid L fed to the sealed space S1 becomes equal to the liquid level LS of the humidifying liquid L remaining in the tank 53, the driving of the pump 55 is stopped. The tank 53 is previously positioned so that when a predetermined amount of humidifying liquid L is fed to the sealed space S1, the liquid level of the fed humidifying liquid L and the liquid level LS of the humidifying liquid L remaining in the tank 53 become equal.

The amount (or the liquid level) of the humidifying liquid fed to the sealed space S1 is set by a sensor provided on the cap 43 or a feed amount of the pump 55, for example. In a case where the sensor is provided, a liquid level sensor for detecting the liquid level of the humidifying liquid L in the cap 43 or a weight sensor for detecting the weight of the humidifying liquid L is used. The sensor is electrically connected to the controller 101. When a predetermined amount of humidifying liquid L is supplied to the cap 43, the sensor transmits a signal to the controller 101. Upon receiving the signal, the controller 101 stops the driving of the pump 55. Alternatively, the value of the predetermined amount is stored in advance in the controller 101, and when it is determined that the fed amount becomes equal to the predetermined amount, the controller 101 stops the driving of the pump 55.

Even when the driving of the pump 55 is stopped, the liquid level of the humidifying liquid L in the tank 53 is equal to the liquid level of the humidifying liquid L in the sealed space S1, so that the reverse flow of the humidifying liquid in the sealed space S1 is prevented. Thus, even after the power of the image forming apparatus 1 is turned off, the predetermined amount of humidifying liquid L is always stored in the sealed space S1.

When the use of the image forming apparatus 1 is restarted, the controller 101 first switches the pump 55 to the normal mode. Thus, the pump 55 is driven in one direction to form the flow passage returning from the pump 55 to the pump 55 through the second communication pipe 62, the internal space S2 of the tank 53, the first communication pipe 61, the sealed space S1 of the cap 43, and the third communication pipe 63. Then, the humidifying liquid L stored in the sealed space S1 is fed into the third communication pipe 63 and returned to the tank 53 through the first communication pipe 61. After the humidifying liquid L stored in the sealed space S1 is completely returned to the tank 53, the capping unit 35 is moved to the housing position and the wiping unit 37 is moved to the wiping position. Thereafter, a purge operation is performed to discharge the ink having absorbed excessive moisture. This operation is referred to as a restart operation.

As described above, according to the humidifying mechanism 51 of the first example, when the power of the image forming apparatus 1 is turned off and left for a long period of time, the long-period leaving operation in which the humidifying liquid L is always stored in the sealed space S1 and the sealed space S1 is maintained at a high humidity is performed. In the restart operation for restarting the use of the image forming apparatus 1 after the long-period leaving operation, it is necessary to return the humidifying liquid L in the sealed space S1 to the tank 53 and then to purge the ink from the nozzle forcibly, as described above. In this case, since it is not necessary to feed the humidified air into the sealed space unlike the above-described technique, the use of the image forming operation can be quickly restarted.

Further, by making the liquid level of the humidifying liquid L in the sealed space S1 equal to the liquid level of the humidifying liquid L in the tank 53, the humidifying liquid can be automatically stored in the sealed space S1 even after the power is turned off (after the pump 55 is stopped).

Figure 5A:
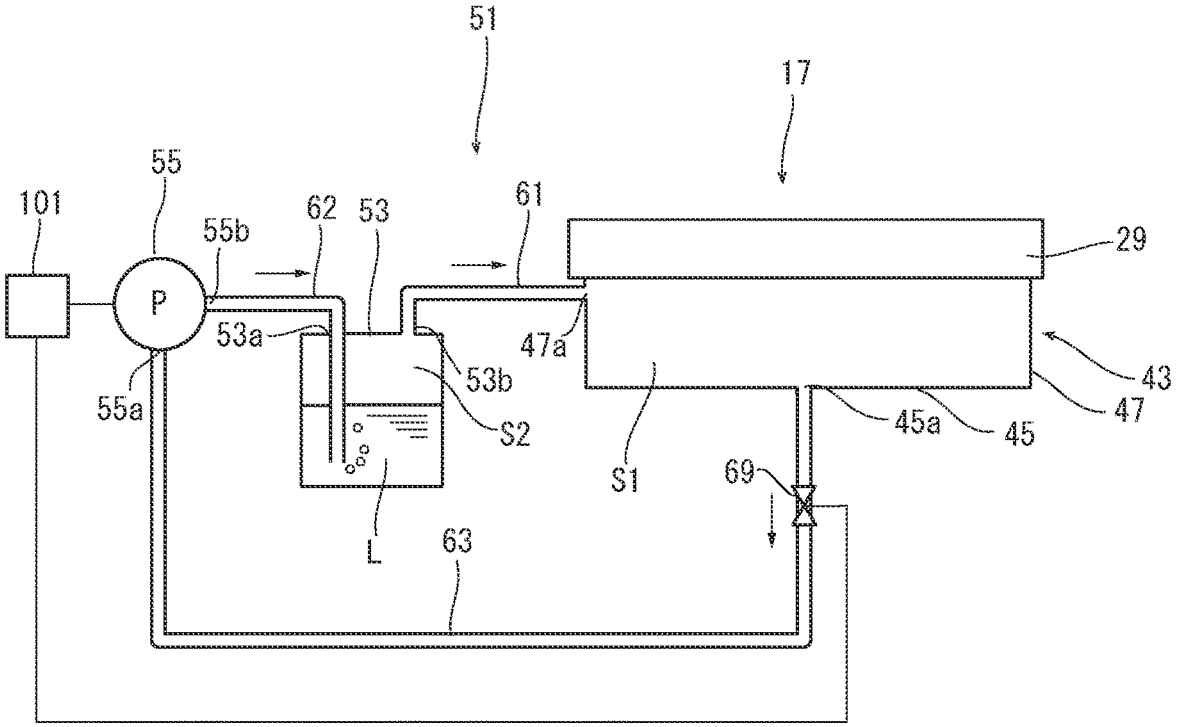
FIG. 5A is a view explaining a humidifying operation at normal use by a humidifying mechanism in the second example, in the image forming apparatus according to the embodiment of the present disclosure.
Figure 5B:
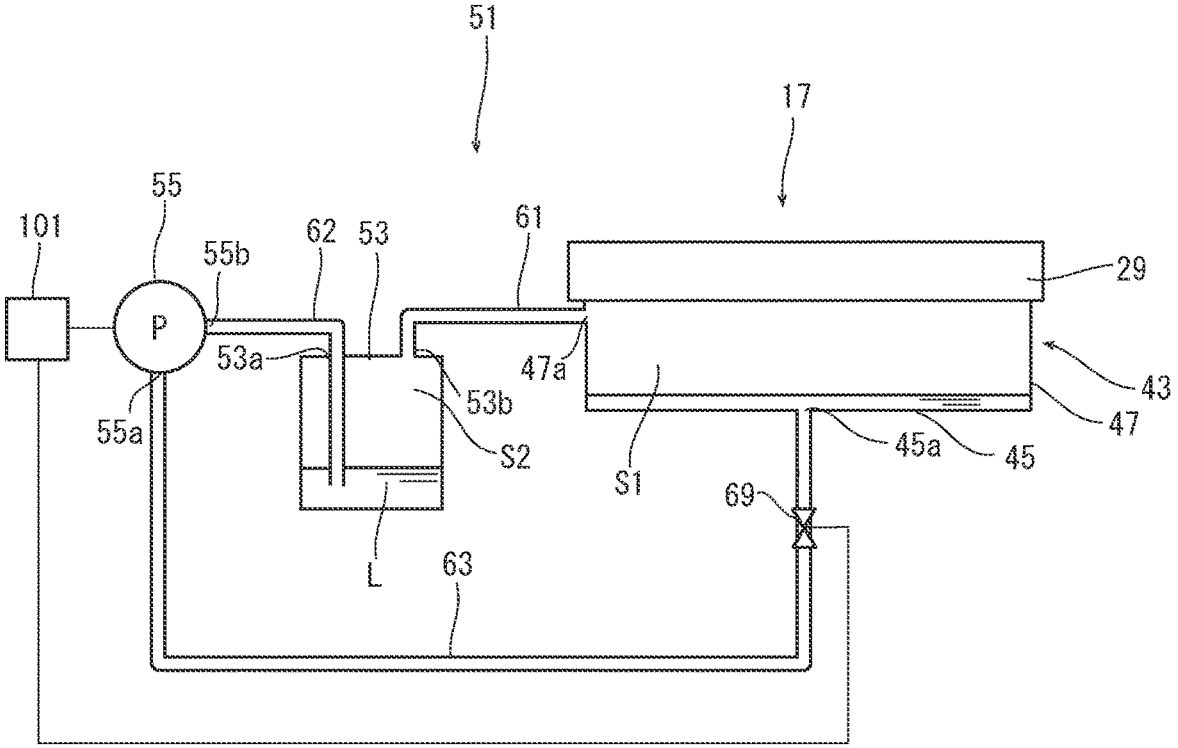
FIG. 5B is a view explaining the humidifying operation at long period non-use by the humidifying mechanism in the second example, in the image forming apparatus according to the embodiment of the present disclosure.

Next, the humidifying mechanism 51 according to the second example will be described with reference to FIG. 5A and FIG. 5B. FIG. 5A and FIG. 5B are views schematically showing the humidifying mechanism 51 according to the second example. In the second example, the third communication pipe 63 is provided with an opening and closing valve 69. The opening and closing valve 69 is electrically connected to the controller 101. When the opening and closing valve 69 is opened by the controller 101, a communication between the sealed space S1 and the pump 55 through the third communication pipe 63 is allowed, and when the opening and closing valve 69 is closed by the controller 101, the communication between the sealed space S1 and the pump 55 through the third communication pipe 63 is cut off. It is preferable that the opening and closing valve 69 has an automatic structure such that the pump pressure >the opening and closing valve 69>the self-pressure of the humidifying liquid in the cap 43 is satisfied, instead of being electrically operated or manually operated.

The humidifying operation by the humidifying mechanism 51 according to the second example having the above configuration will be described. In the capping operation, the controller 101 opens the opening and closing valve 69 to allow the communication between the sealed space S1 and the pump 55. Thereafter, the controller 101 switches the pump 55 to the normal mode. Then, the pump 55 is driven in one direction, and the flow passage returning from the pump 55 to the pump 55 through the second communication pipe 62, the internal space S2 of the tank 53, the first communication pipe 61, the sealed space S1 of the cap 43, and the third communication pipe 63 is formed. Thereby, the humidified air in the tank 53 is fed into the sealed space S1 through the first communication pipe 61, and then the sealed space S1 is humidified.

In the long-period leaving operation, before the power of the image forming apparatus 1 is turned off, the controller 101 opens the opening and closing valve 69 to allow the communication between the sealed space S1 and the pump 55. Further, the controller 101 switches the pump 55 to the reverse rotation mode. Then, the pump 55 is driven in the other direction, and a flow passage returning from the pump 55 to the pump 55 through the third communication pipe 63, the sealed space S1 of the cap 43, the first communication pipe 61, the internal space S2 of the tank 53, and the second communication pipe 62 is formed. As a result, the humidifying liquid L in the tank 53 is fed into the third communication pipe 63, passed through the third communication pipe 63, and fed to the sealed space S1 from the outflow port 45*a* of the bottom wall 45 of the cap 43.

After a predetermined amount of humidifying liquid L is stored in the sealed space S1, the controller 101 closes the opening and closing valve 69 to cut off the communication between the sealed space S1 and the pump 55, and stops the driving of the pump 55. When the driving of the pump 55 is stopped, the force for feeding the humidifying liquid L to the sealed space S1 disappears, so that the humidifying liquid L stored in the sealed space S1 flows into the third communication pipe 63 by its own weight. However, since the opening and closing valve 69 is closed and the communication between the sealed space S1 and the pump 55 is cut off, backflow of the humidifying liquid L is prevented.

As described above, also according to the humidifying mechanism 51 of the second example, when the power of the image forming apparatus 1 is turned off and left for a long period of time, the long-period leaving operation in which the humidifying liquid L is always stored in the sealed space S1 and the sealed space S1 is maintained at a high humidity is performed. Therefore, when the purge operation is performed at the time of restarting the use of the image forming apparatus 1, it is not necessary to feed the humidified air into the sealed space, so that the image forming operation can be quickly restarted.

Further, by providing the opening and closing valve 69 in the third communication pipe 63, the humidified water can be stored in the sealed space S1 even after the driving of the pump 55 is stopped. Further, since it is not necessary to adjust the positional relationship between the sealed space S1 and the tank 53, the position of the tank 53 can be freely set.

The bottom wall 45 of the cap 43 is preferably inclined downward toward the outflow port 45*a*. In this case, when the humidifying liquid L stored in the sealed space S1 is returned to the tank 53 through the third communication pipe 63 and the first communication pipe 61 when the use of the image forming apparatus 1 is restarted, the humidifying liquid L in the sealed space S1 easily flows toward the outflow port 45*a*, and the stored humidifying liquid L can be returned to the tank 53 without being left.

In the above embodiments, in a case where the power of the image forming apparatus 1 is turned off and left for a long period of time, the controller 101 performs the long-period leaving operation. In this case, the power source of the pump 55 is provided separately from the main power source of the image forming apparatus 1, and the power source for the pump and the main power source are electrically connected to the controller 101. When the main power source turned off, a signal is transmitted to the controller 101. Upon receiving the signal, the controller 101 controls the power source for the pump to perform the long-period leaving operation.

Although the present disclosure has been described for specific embodiments, the present disclosure is not limited to the above embodiments. Those skilled in the art may modify the embodiments described above without departing from the scope and spirit of the present disclosure.

The invention claimed is:

1. An image forming apparatus comprising:

a recording head having a lower surface on which an ink ejection port is formed;

a cap which forms a sealed space including the ejection port;

a tank which is connected to the sealed space through a first communication pipe and stores a humidifying liquid to generate a humidified air;

a pump which feeds air into the humidifying liquid in the tank through a second communication pipe and feeds the humidified air to the sealed space through the first communication pipe;

a third communication pipe connecting the pump and the sealed space; and a controller which is performable a capping operation to drive the pump in one direction to feed the humidified air to the sealed space and a long-period leaving operation to drive the pump in the other direction to feed the humidifying liquid in the tank to the sealed space through the third communication pipe and to stop a driving of the pump after a predetermined amount of the humidifying liquid is fed in the sealed space, wherein in the long-period leaving operation, a liquid level of the humidifying liquid stored in the sealed space is equal to a liquid level of the humidifying liquid remaining in the tank.

2. The image forming apparatus according to claim 1, wherein the third communication pipe is connected to an outflow port formed in a bottom plate of the cap, and the bottom plate is formed so as to be inclined downward toward the outflow port.

3. The image forming apparatus according to claim 1, further comprising an opening and closing valve which is controlled by the controller to open and close the third communication pipe, wherein in the capping operation, the controller opens the opening and closing valve, drives the pump in one direction to feed the humidified air in the tank through the first communication pipe into the sealed space, then closes the opening and closing valve, and then stops the driving the pump, and in the long-period leaving operation, the controller opens the opening and closing valve, drives the pump in the other direction to feed the humidifying liquid in the tank through the third communication pipe into the sealed space, then closes the opening and closing valve and then stops the driving of the pump after a predetermined amount of the humidifying liquid is stored in the sealed space.

4. The image forming apparatus according to claim 1, wherein the controller can perform a restart operation to drive the pump in one direction to return the humidifying liquid fed in the sealed space to the tank after a purge operation for the recording head is performed after the long-period leaving operation, and then to perform the purge operation for the recording head.

5. An image forming apparatus comprising:

a recording head having a lower surface on which an ink ejection port is formed;

a cap which forms a sealed space including the ejection port;

a tank which is connected to the sealed space through a first communication pipe and stores a humidifying liquid to generate a humidified air;

a pump which feeds air into the humidifying liquid in the tank through a second communication pipe and feeds the humidified air to the sealed space through the first communication pipe;

a third communication pipe connecting the pump and the sealed space;

a controller which is performable a capping operation to drive the pump in one direction to feed the humidified air to the sealed space and a long-period leaving operation to drive the pump in the other direction to feed the humidifying liquid in the tank to the sealed space through the third communication pipe and to stop a driving of the pump after a predetermined amount of the humidifying liquid is fed in the sealed space; and an opening and closing valve which opens and closes the third communication pipe, wherein the opening and closing valve has an automatic structure in which the pressure of the pump >the pressure of the opening and closing valve >the self-pressure of the humidifying liquid in the cap is satisfied.

* * * * *